US011466462B2

(12) United States Patent
Shelton et al.

(10) Patent No.: US 11,466,462 B2
(45) Date of Patent: Oct. 11, 2022

(54) ROTATING MOUNT FOLDING GUARDRAIL

(71) Applicant: The Boeing Company, Chicago, IL (US)

(72) Inventors: Tyler J. Shelton, Kent, WA (US); Tuan-Vu T. Phan, Kent, WA (US); Scott L. Rost, Graham, WA (US)

(73) Assignee: The Boeing Company, Chicago, IL (US)

( * ) Notice: Subject to any disclaimer, the term of this patent is extended or adjusted under 35 U.S.C. 154(b) by 619 days.

(21) Appl. No.: 16/128,946

(22) Filed: Sep. 12, 2018

(65) Prior Publication Data

US 2020/0080315 A1 Mar. 12, 2020

(51) Int. Cl.
*E04F 11/18* (2006.01)

(52) U.S. Cl.
CPC ..... *E04F 11/1834* (2013.01); *E04F 11/1865* (2013.01); *E04F 2011/1876* (2013.01)

(58) Field of Classification Search
CPC ..... E01F 13/06; E01F 13/065; E01F 15/0415; E04F 11/04; E04F 11/1834; E04F 11/1865; E04F 2011/1876; E06C 1/393; B64F 1/315; E04G 21/3232; E04G 21/3228; E04G 5/04
USPC ..... 256/26; 182/113
See application file for complete search history.

(56) References Cited

U.S. PATENT DOCUMENTS 2,551,208 A * 5/1951 Garner ..... E04F 11/04 182/80
4,490,068 A * 12/1984 Dickinson ..... E01F 13/08 404/11
4,936,407 A * 6/1990 Brock ..... B60R 3/005 180/271
5,639,178 A * 6/1997 Wilson ..... E01F 13/085 49/35

(Continued)

FOREIGN PATENT DOCUMENTS

CN 108360418 A * 8/2018
CN 108756100 A * 11/2018 ..... E06C 1/393

(Continued)

OTHER PUBLICATIONS

Danielle Collins, Linear actuators: Pneumatic or electric, May 2018, Linear Motion Tips (Year: 2018).*

*Primary Examiner* — Michael P Ferguson
*Assistant Examiner* — Zachary A Hall
(74) *Attorney, Agent, or Firm* — McDonnell Boehnen Hulbert & Berghoff LLP

(57) ABSTRACT

The present disclosure relates systems and methods involving movable/adjustable guardrails. An example system includes at least one rotating mount having a lower weldment rotatably coupled to an upper weldment. The lower weldment is coupled to a walking surface. The system also includes a guardrail weldment coupled to the upper weldment of the at least one rotating mount. The system additionally includes an actuator configured to controllably adjust a configuration of the guardrail weldment between an (Continued)

extended configuration and a retracted configuration with respect to the walking surface. In some embodiments, the system could include a remote unit configured to control a position of the actuator. For example, the remote unit could include a wired remote controller having a user interface and at least one button.

20 Claims, 11 Drawing Sheets

(56) References Cited

U.S. PATENT DOCUMENTS 7,174,993 B2 * 2/2007 Lantz ..... E06C 7/006 182/127
D656,442 S * 3/2012 Hanks ..... D12/194
8,439,594 B1 * 5/2013 Clark ..... E01F 13/123 404/9
8,632,099 B2 * 1/2014 Conny ..... B60R 3/005 280/837
8,813,912 B2 * 8/2014 Bennett ..... B66F 11/04 182/113
8,956,072 B2 * 2/2015 Brackin ..... E01F 13/048 404/6
9,816,318 B2 * 11/2017 Johnson ..... E06C 7/183
10,053,204 B2 * 8/2018 King ..... B64C 1/066
10,099,623 B2 * 10/2018 Hamaguchi ..... B60R 3/02
10,179,638 B2 * 1/2019 King ..... B64C 1/066
10,780,831 B2 * 9/2020 Oliver ..... B60R 3/005
2006/0284145 A1 * 12/2006 Hillsamer ..... B66F 3/245 254/11
2015/0034418 A1 * 2/2015 Melton ..... B66F 17/006 182/113
2015/0060202 A1 * 3/2015 Fanello ..... B60R 3/005 182/113
2015/0136523 A1 * 5/2015 Madera ..... E06C 5/04 182/113
2015/0182831 A1 * 7/2015 Lamascus ..... A63B 63/083 473/483
2015/0246643 A1 * 9/2015 Levi ..... B60R 9/045 182/113
2016/0244944 A1 * 8/2016 Ellement ..... B60R 3/02
2016/0280237 A1 * 9/2016 Thompson ..... E05F 15/57
2017/0246992 A1 * 8/2017 Giesmann ..... B60R 3/02
2018/0135307 A1 * 5/2018 Moran ..... E04F 11/1865
2018/0272951 A1 * 9/2018 Oliver ..... B60R 3/005
2019/0304220 A1 * 10/2019 Lee ..... G08G 1/04

FOREIGN PATENT DOCUMENTS

DE 102015120302 A1 * 5/2017 ..... E01F 13/06
EP 2011957 A1 * 1/2009 ..... E06C 1/393
FR 2996238 A1 * 4/2014 ..... E04F 11/1865
KR 100566322 B1 * 3/2006
KR 100605337 B1 * 8/2006
KR 101346068 B1 * 12/2013
WO WO-2012123672 A2 * 9/2012 ..... E02D 29/127
WO WO-2014055545 A1 * 4/2014 ..... E01F 13/048

* cited by examiner

ROTATING MOUNT FOLDING GUARDRAIL

FIELD

The present disclosure generally relates to systems and methods involving adjustable and/or movable guardrails.

BACKGROUND

During their manufacture in an airplane production facility, aircraft move along the production line between different stages of assembly. This periodic (e.g., daily) movement is called "pulsing" the production line.

In some stages of assembly, movable deck platforms may provide personnel access to elevated portions of the airplane. To avoid falls from the movable deck platform, such platforms may include various guardrails.

Currently, prior to pulsing the production line, some guardrails on the movable deck platforms need to be manually removed (e.g., by hand) so they do not impede the progress of airplanes as they move along the production line. Once a new airplane is in a proper position along the production line, the guardrails are manually reinstalled so as to protect personnel from various hazards.

Frequent handling of the removable guardrails sections, which can weigh 40 pounds, or more, can lead to repetitive lift injuries. Furthermore, personnel who install and remove the guardrails can be at particular risk of falling.

SUMMARY

In an aspect, a system is described. The system includes at least one rotating mount having a lower weldment rotatably coupled to an upper weldment. The lower weldment is coupled to a walking surface. The system also includes a guardrail weldment coupled to the upper weldment of the at least one rotating mount. Additionally, the system includes an actuator configured to controllably adjust a configuration of the guardrail weldment between an extended configuration and a retracted configuration with respect to the walking surface.

In another aspect, a movable deck platform is described. The movable deck platform includes a walking surface. The movable deck platform includes at least one rotating mount having a lower weldment rotatably coupled to an upper weldment. The lower weldment is coupled to the walking surface. The movable deck platform includes a guardrail weldment coupled to the upper weldment of the at least one rotating mount. The movable deck platform also includes an actuator configured to controllably adjust a configuration of the guardrail weldment between an extended configuration and a retracted configuration with respect to the walking surface.

In a further aspect, a method is described. The method includes receiving information indicative of a desired configuration or a desired movement of a guardrail weldment. The method includes determining, based on the received information, that the desired configuration or the desired movement includes at least one of an extended configuration or a retracted configuration with respect to a walking surface. The method further includes rotatably adjusting the guardrail weldment with respect to the walking surface according to the desired configuration or the desired movement.

Other aspects, examples, and implementations will become apparent to those of ordinary skill in the art by reading the following detailed description with reference, where appropriate, to the accompanying drawings.

BRIEF DESCRIPTION OF THE FIGURES

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying drawings, wherein:

DETAILED DESCRIPTION

I. Overview

Figure 1:
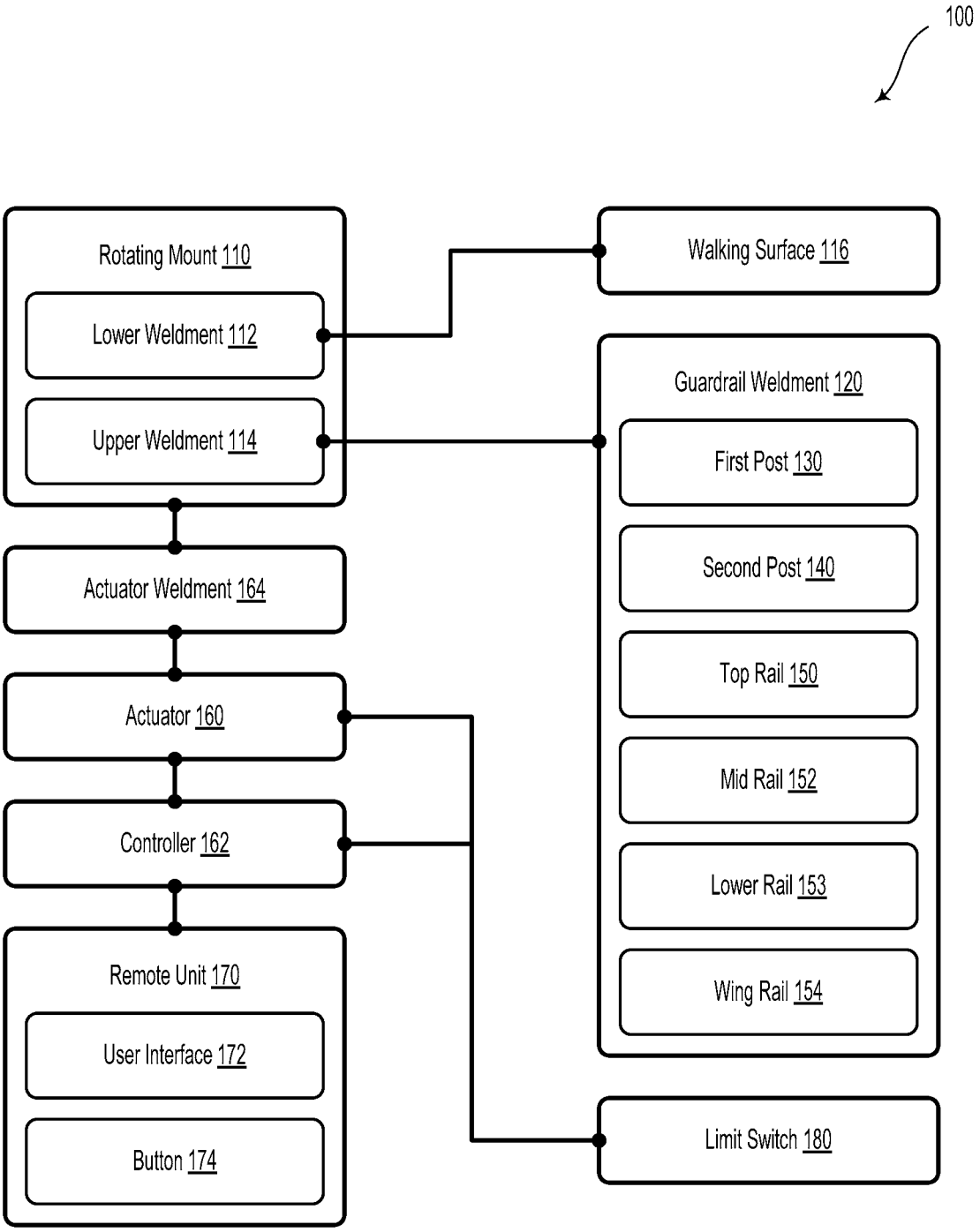
FIG. 1 illustrates a system, according to an example implementation.

Example methods, devices, and systems are described herein. It should be understood that the words "example" and "exemplary" are used herein to mean "serving as an example, instance, or illustration." Any example or feature described herein as being an "example" or "exemplary" is not necessarily to be construed as preferred or advantageous over other examples or features. Other examples can be utilized, and other changes can be made, without departing from the scope of the subject matter presented herein.

Thus, the examples described herein are not meant to be limiting. Aspects of the present disclosure, as generally described herein, and illustrated in the figures, can be arranged, substituted, combined, separated, and designed in a wide variety of different configurations, all of which are contemplated herein.

Further, unless context suggests otherwise, the features illustrated in each of the figures may be used in combination with one another. Thus, the figures should be generally viewed as component aspects of one or more overall examples, with the understanding that not all illustrated features are necessary for each example.

The present disclosure relates to rotating mount guardrails that can retract and extend in an automated fashion without exposing personnel to injury risks. The systems and methods for rotating mount guardrails could be implemented on movable deck platforms or in other similar scenarios. In such examples, tooling personnel can retract and extend the rotating mount guardrails before and after pulsing of the production line instead of manually lifting, carrying, and installing guardrails onto the deck platforms.

In some embodiments, the rotating mount guardrails could rotatably retract so as to be parallel with the deck surface. Furthermore, the rotating mount folding guardrails can be extended and retracted using electric linear actuators that may be controlled with a hand remote.

A guardrail weldment could be formed from steel or aluminum members that could be coupled together via welding or by other fastening techniques. At its base, the guardrail weldment could be coupled (e.g., bolted) to a set of rotating mounts, which could be anchored to the movable deck platform. The rotating mounts could utilize a hinged clevis design consisting of an upper and lower weldment assembled with bronze bearings, and a stripper bolt for the pin. A clevis weldment could bolt to both rotating mounts and could transmit the motion of the actuator to the guardrail. In such a scenario, the guardrail can rotate approximately 90° between a vertical extended position and a horizontal retracted position where it lays closely to the deck surface. An electric actuator running through a slot in the deck pins to the clevis weldment and a mount located below the deck surface.

In some embodiments, the guardrail system described herein complies with various federal and state safety guidelines, such as, but not limited to Occupational Safety and Health Administration (OSHA) Regulation 1910.29 (Fall protection systems). Other United States and international safety standards could be addressed by way of the present guardrail system as well.

II. Example Systems

FIG. 1 illustrates a system 100, according to an example implementation. The system 100 includes at least one rotating mount 110, which could include a lower weldment 112 rotatably coupled to an upper weldment 114. In such scenarios, the lower weldment 112 could be coupled to a walking surface 116. While the term "weldment" is used herein, it will be understood that such parts (e.g., the lower weldment 112 and/or upper weldment 114) could additionally or alternatively be formed from machined parts.

In some embodiments, the at least one rotating mount 110 could be formed from round and/or square metal tubing, rods, or bars. It will be understood that the at least one rotating mount 110 could include other shapes. The at least one rotating mount 110 could be formed from one or materials such as aluminum, steel, and/or another material.

In some embodiments, the lower weldment 112 is rotatably coupled to the upper weldment 114 by way of at least one of: (i) a rotary bearing; or (ii) at least one rotary bushing and a stripper bolt. Other types of flexible and/or adjustable couplings are contemplated to join the lower weldment 112 and the upper weldment 114. It will be understood that other types of rotatable couplings are contemplated herein. For example, without limitation, the lower weldment 112 could be rotatably coupled to the upper weldment 114 by way of a plain bearing (e.g., sleeve bearing/bushing), a ball bearing, roller bearing, etc.

The system 100 also includes a guardrail weldment 120 coupled to the upper weldment 114 of the at least one rotating mount 110. The guardrail weldment 120 could include various combinations of posts and/or rails. In some embodiments, the guardrail weldment 120 could include a first post 130, a second post 140, a top rail 150, a mid rail 152, and a lower rail 153. In some embodiments, the guardrail weldment 120 could include a plurality of posts and one or more of the respective rails (the top rail 150, the mid rail 152, and/or the lower rail 153) are coupled to at least two posts.

In some embodiments, the guardrail weldment 120 could include a wing rail 154. Namely, the top rail 150, the mid rail 152, and/or the lower rail 153 could extend beyond a span between the first post 130 and the second post 140 to provide a wing rail 154. The wing rail 154 may provide a barrier and/or fall protection for areas located between multiple adjacent rail assemblies and/or outside the span between the first post 130 and the second post 140.

Additionally or alternatively, the guardrail weldment 120 could include at least one baluster rotatably coupled between the at least one rotating mount 110 and at least one of the top rail 150, the mid rail 152, or the lower rail 153. As an example, the at least one baluster could provide a vertical barrier between the first post 130 and the second post 140.

As an example, the guardrail weldment 120 could be rotatably coupled to the at least one rotating mount 110 by way of at least one of: a clevis pin, a rotary bearing, or a rotary bushing. In such a manner, various portions of the guardrail weldment 120 (e.g., first post 130 and second post 140) could be configured to rotate with respect to the at least one rotating mount 110. In so doing, the guardrail weldment 120 could be controllably raised or retracted in a foldable manner.

System 100 additionally includes an actuator 160 configured to controllably adjust a configuration of the guardrail weldment 120 between an extended configuration and a retracted configuration with respect to the walking surface 116. In some embodiments, the actuator 160 could include an electric ball-screw linear actuator. However, other types of actuators are contemplated and possible, including, without limitation, pneumatic actuators, rotary actuators, or hydraulic actuators.

In some embodiments, the actuator 160 could include an actuator arm having a throw range between 100 mm to 300 mm. Other throw ranges are possible and contemplated. The actuator 160 could be coupled to the rotating mount 110 by way of an actuator weldment 164. Furthermore, the actuator 160 could be communicatively coupled to a controller 162 and/or a remote unit 170. It will be understood that other arrangements of the actuator 160 with respect to the guardrail weldment 120, the walking surface 116, and the rotating mount 110 are possible and contemplated so as to controllably adjust the configuration of the guardrail weldment 120 as described herein.

The system 100 also includes a remote unit 170 configured to control a position of the actuator 160. The remote unit 170 includes a wired remote controller having a user interface 172. In some embodiments, the user interface 172 includes at least one button 174. In some embodiments, a user could press the at least one button 174 to provide a command to extend or retract the guardrail weldment 120. For instance, the remote unit 170 could include an "EXTEND" button and a "RETRACT" button. User interactions with such buttons could provide corresponding commands to the actuator 160 and/or controller 162 to adjust a position of the guardrail weldment 120.

In some embodiments, the walking surface 116 defines a reference plane. In such scenarios, the extended configuration includes the guardrail weldment 120 extending substantially perpendicular from the reference plane. The retracted configuration includes the guardrail weldment 120 disposed substantially parallel to the reference plane.

Figure 2:
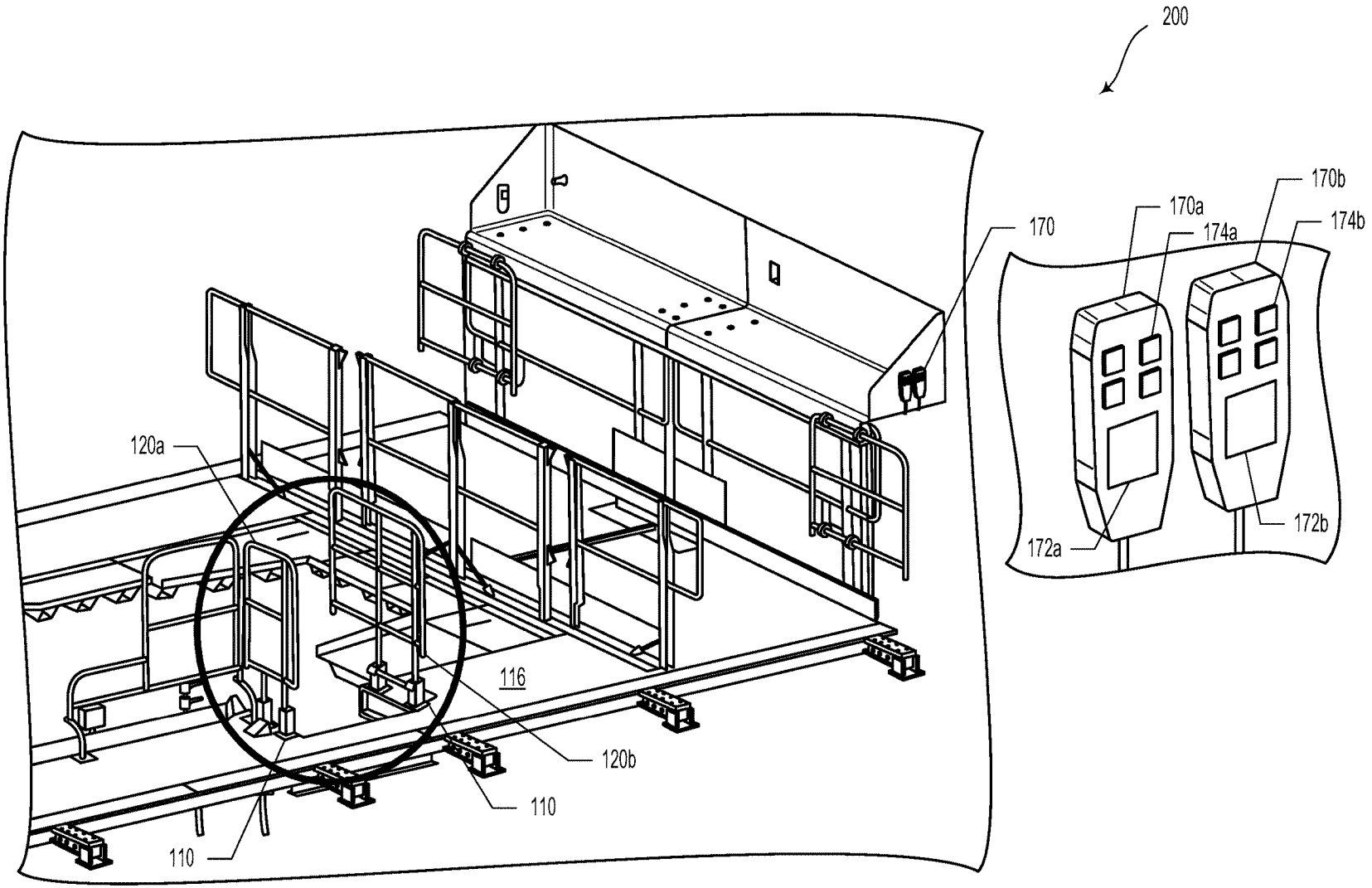
FIG. 2 illustrates a system, according to an example implementation.

FIG. 2 illustrates a system 200, according to an example implementation. It will be understood that system 200 could be similar or identical to system 100 as illustrated and described in relation to FIG. 1. System 200 illustrates guardrail weldments 120*a* and 120*b*. Other guardrail structures are also illustrated. For clarity, only a subset of the total structures of the guardrail weldments 120*a* and 120*b* are specifically numbered in FIG. 2. Other Figures will provide further details about the guardrail weldment 120.

Guardrail weldment 120 could be coupled to walking surface 116 by way of one or more rotating mounts 110. The guardrail weldment 120 could include a plurality of posts (e.g., first post 130 and second post 140), a top rail 150, a wing rail 154, and a mid rail 152.

As illustrated in FIG. 2, System 200 could include a plurality of remote units 170. In some embodiments, system 200 could include a first remote unit 170*a* and a second remote unit 170*b*. In such scenarios, the first remote unit 170*a* could include a plurality of buttons 174*a* and a user interface 172*a*. Furthermore, the second remote unit 170*b* could include a plurality of buttons 174*b* and a user interface 172*b*. In examples, the first remote unit 170*a* could be operable to control a first guardrail weldment and the second remote unit 170*b* could be operable to control a second guardrail weldment. In other embodiments, the respective remote units could control different types of movable and/or foldable guardrails.

While FIG. 2 illustrates one possible location for the remote units 170, it will be understood that other locations are possible and contemplated. For example, the remote units 170 could be located near the one or more rotating mounts 110 in the form of a footswitch or pedal. Alternatively, the remote units 170 could be located at a control room or on a centralized control panel. In some embodiments, the remote units 170 could be realized in the form of a mobile computing device, such as a tablet device, a smartphone, or a laptop computer.

Figure 3:
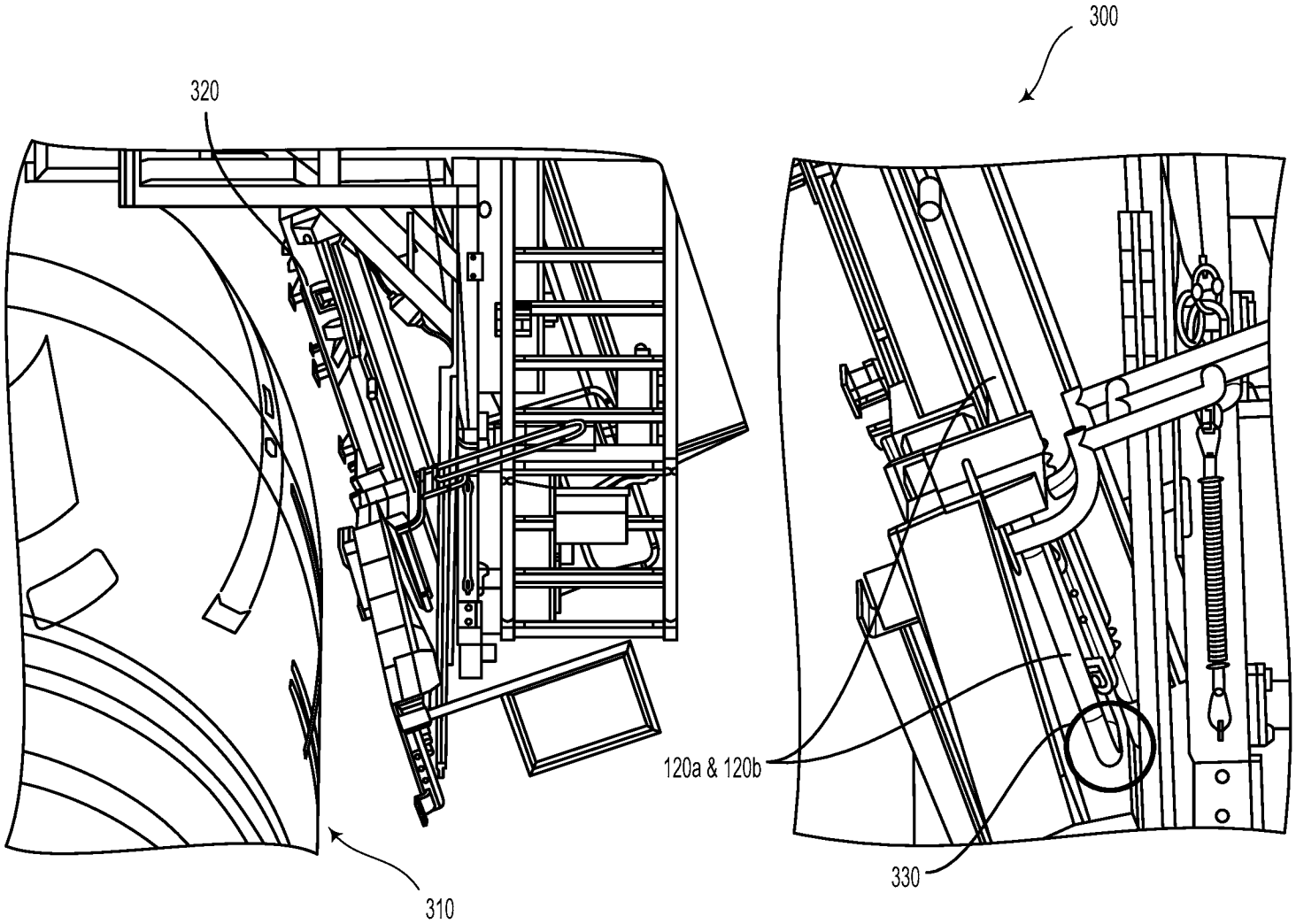
FIG. 3 illustrates a movable deck platform, according to an example implementation.

FIG. 3 illustrates a movable deck platform 300, according to an example implementation. The movable deck platform 300 could include a platform 320 that is operable to rotate or fold so as to provide clearance for an aircraft 310 to move along an aircraft assembly line. Other types of movable deck platforms are possible and contemplated herein. In some embodiments, systems 100 or 200 could be incorporated into the movable deck platform 300. For example, the guardrail weldments (e.g., guardrail weldments 120*a* and 120*b*) described herein could be foldably retracted so as to provide clearance 330 so the platform 320 could be rotated up and away from the aircraft 310.

After "pulsing" the aircraft assembly line, the movable deck platform 300 could rotate to a substantially horizontal position to provide a walking surface/working platform for personnel. Once rotated into a substantially horizontal position, the foldable guardrails described herein could be adjusted to their extended configuration, protecting personnel who may work on the movable deck platform 300.

Figure 4:
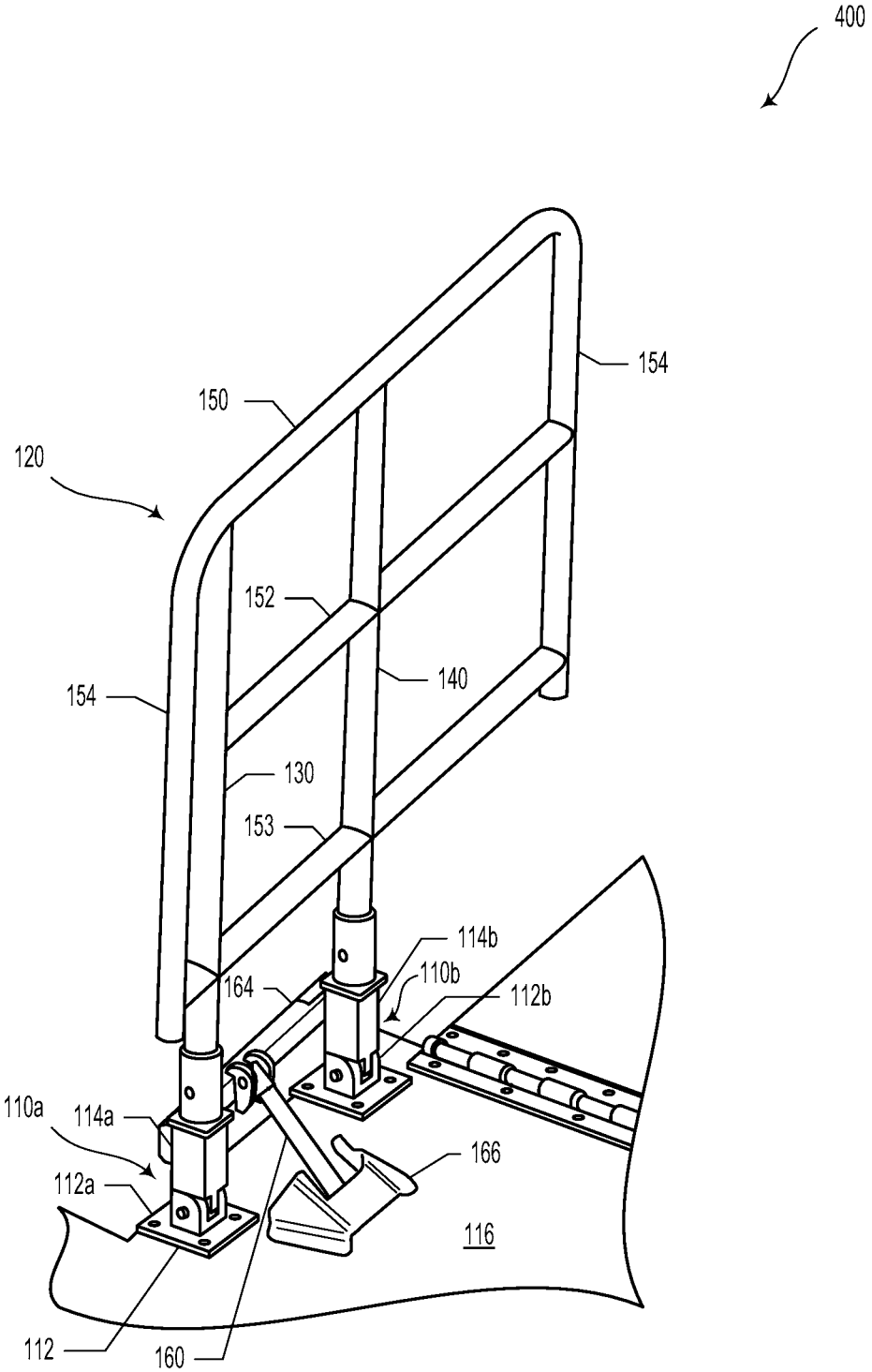
FIG. 4 illustrates a system, according to an example implementation.

FIG. 4 illustrates a system 400, according to an example implementation. As illustrated in FIG. 4, system 400 could include a guardrail weldment 120 that is attached to a walking surface 116 by way of a first rotating mount 110*a* and a second rotating mount 110*b*. In such scenarios, the first post 130 of the guardrail weldment 120 is coupled to an upper weldment 114*a* of a first rotating mount 110*a*. Furthermore, the second post 140 is coupled to an upper weldment 114 of a second rotating mount 110*b*. In such scenarios, the first rotating mount 110*a* and the second rotating mount 110*b* could be configured to rotate about a shared rotational axis (e.g., rotational axis 113 as illustrated and described in reference to FIG. 8). By rotating the guardrail weldment 120 about the shared rotational axis, the guardrail weldment 120 can be lowered for compact stowage and raised for normal platform operations.

In some examples, a first end of the actuator 160 is coupled to the guardrail weldment 120 by way of an actuator weldment 164. A second end of the actuator 160 is coupled to the walking surface 116.

In scenarios in which the guardrail weldment 120 includes a first post 130 and a second post 140, the actuator weldment 164 can be coupled to an upper weldment 114*a* of a first rotating mount 110*a* and an upper weldment 114*b* of a second rotating mount 110*b*. In some embodiments, the first end of the actuator 160 could be coupled to a middle portion of the actuator weldment 164.

In some embodiments, adjusting the configuration of the guardrail weldment 120 between the extended configuration and the retracted configuration could include rotatably adjusting a position of the guardrail weldment 120 with respect to the walking surface 116.

In some scenarios, the walking surface 116 could be defined by an upper surface of a deck platform. A first end of the actuator 160 is coupled to the guardrail weldment 120 by way of an actuator weldment 164. Furthermore, a second end of the actuator 160 could be coupled to a lower surface of the deck platform.

In such situations, the lower surface of the deck platform could include an underside surface of the deck platform. The lower surface of the deck platform could, for example, be disposed opposite the upper surface (e.g., the walking surface 116) of the deck platform.

In some embodiments, at least a portion of the actuator 160 could pass through an opening in the upper surface of the deck platform. By passing through the surface of the deck platform, the actuator 160 could be mostly, or completely, located below the walking surface when the guardrail weldment 120 is in a retracted configuration, improving compact stowage. In such scenarios, the opening could be at least partially covered by an actuator cover 166. For example, the actuator cover 166 could prevent debris and other foreign objects from falling through the deck platform.

In some embodiments, system 100 could include a controller 162. The controller 162 could include a computer, or another type of microcontroller configured to execute instructions so as to carry out various operations. For example, the controller 162 may include one or more processors and at least one memory. The processor(s) may include, for instance, a microprocessor, an application-specific integrated circuit (ASIC), or a field-programmable gate array (FPGA). Other types of processors, circuits, computers, or electronic devices configured to carry out software instructions are contemplated herein.

The memory may include a non-transitory computer-readable medium, such as, but not limited to, read-only memory (ROM), programmable read-only memory (PROM), erasable programmable read-only memory (EPROM), electrically erasable programmable read-only memory (EEPROM), non-volatile random-access memory (e.g., flash memory), a solid state drive (SSD), a hard disk drive (HDD), a Compact Disc (CD), a Digital Video Disk (DVD), a digital tape, read/write (R/W) CDs, R/W DVDs, etc.

The one or more processors of controller 162 may be configured to execute instructions stored in the memory so as to carry out various operations and method steps/blocks described herein. The instructions may be stored in a permanent or transitory manner in the memory.

In some embodiments, the instructions could relate to operations, such as, responsive to receiving information indicative of an extension command, causing the actuator 160 to move the guardrail weldment 120 into the extended configuration. This is beneficial because the controller-based operations could take the place of, or supplement, aircraft assembly line pulsing activities. Namely, instead of using personnel to manually replace guardrails, the guardrail weldment 120 could be automatically or semi-automatically rotated into the extended configuration with the systems and methods described herein.

Furthermore, the operations could include, responsive to receiving information indicative of a retraction command, causing the actuator 160 to move the guardrail weldment 120 into the retracted configuration. Similar to the benefits stated above, this operation is beneficial because it could replace or reduce the need for personnel to manually remove guardrails from the deck platform during pulsing operations. Furthermore, such controller-based (e.g., automated or semi-automated) operations could prevent injuries to worker personnel, such as repetitive-use injuries and falls.

The systems described herein could additionally or alternatively include at least one limit switch 180. The at least one limit switch 180 is configured to providing information indicative of the guardrail weldment 120 reaching a position limit. In such scenarios, causing the actuator 160 to move the guardrail weldment 120 includes moving the guardrail weldment 120 until receiving the information indicative of the guardrail weldment 120 reaching the position limit. In response to such scenarios, the controller 162 could stop adjusting the actuator 160, thereby stopping movement of the guardrail weldment 120.

The at least one limit switch 180 could include a switch, button, or another type of sensor. The at least one limit switch 180 could operate based on mechanical, opto-mechanical, magnetic, or optical sensing modalities. However, other types of limit switches or contact/proximity sensors are possible and contemplated.

It will be understood that the controller 162 could be configured to carry out operations involving multiple actuators and corresponding guardrail weldments. For example, in some embodiments, system 100 could include a further guardrail weldment and a further actuator. In such scenarios, the further guardrail weldment and the further actuator are coupled to one or more further rotating mounts 110. The further actuator could be configured to controllably adjust a configuration of the further guardrail weldment between an extended configuration and a retracted configuration with respect to the further rotating mount(s) 110.

Figure 5:
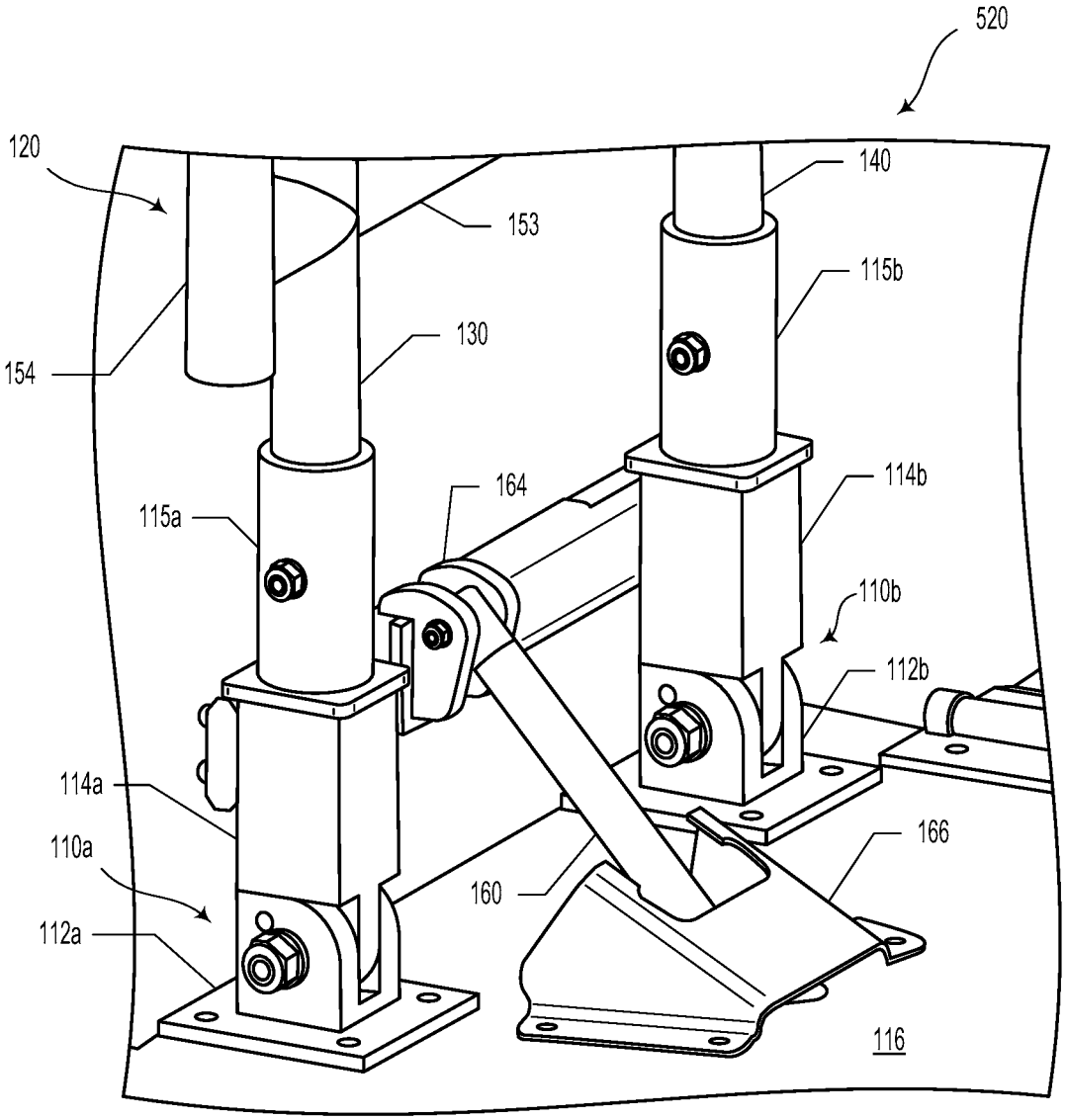
FIG. 5 illustrates a portion of the system of FIG. 4, according to an example implementation.

FIG. 5 illustrates a portion 520 of the system 400 of FIG. 4, according to an example implementation. Namely, FIG. 5 illustrates a base portion of the guardrail weldment 120 where it couples to the first rotating mount 110*a* and the second rotating mount 110*b*. As illustrated, the first rotating mount 110*a* and the second rotating mount 110*b* could include receivers 115*a* and 115*b* configured to receive the first post 130 and the second post 140, respectively. Furthermore, the respective receivers 115*a* and 115*b* could include one or more sets of through holes, bolts, and nuts that could be utilized so as to fasten or fix the first post 130 to the first rotating mount 110*a* and the second post 140 to the second rotating mount 110*b*.

Figure 6:
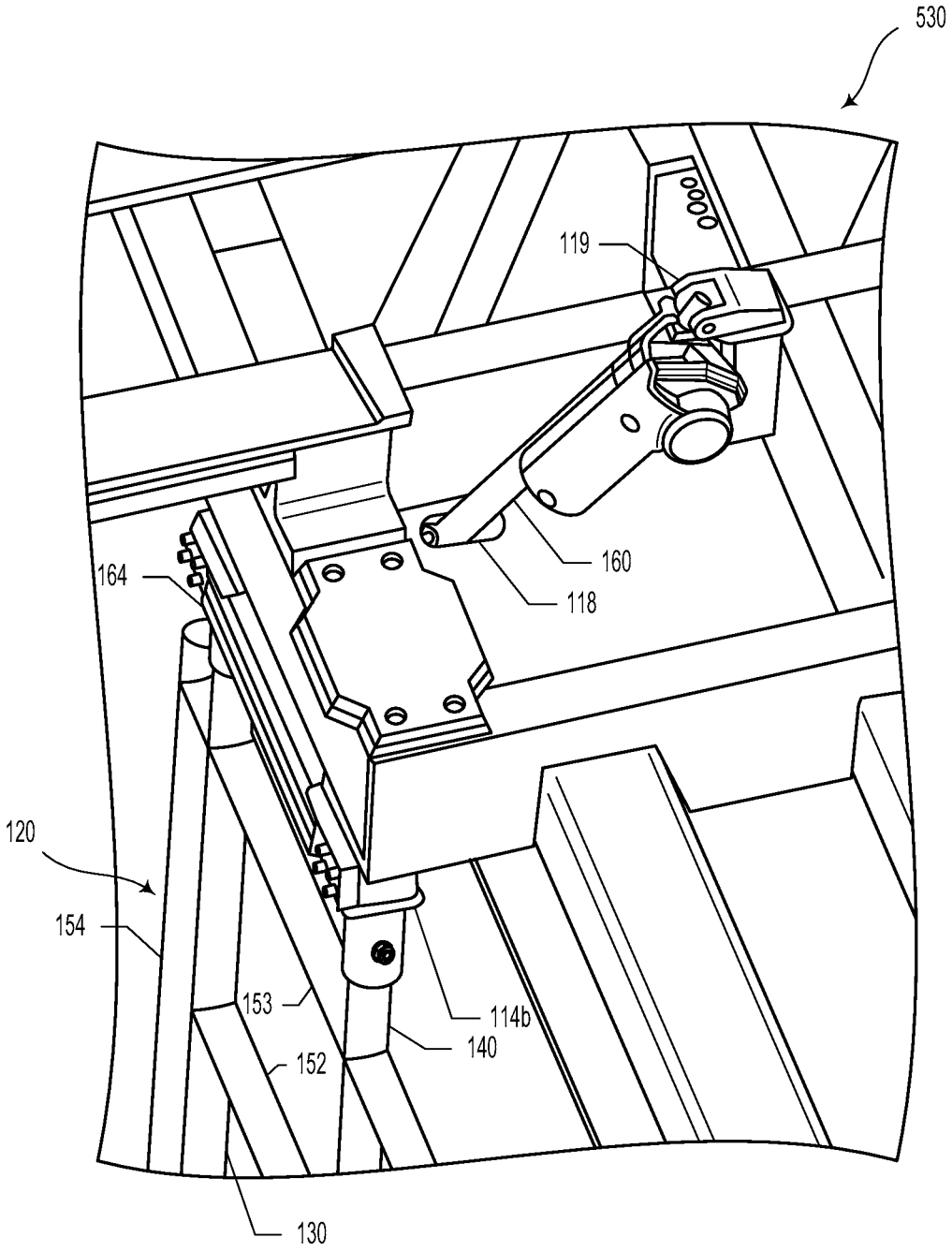
FIG. 6 illustrates a portion of the system of FIG. 4, according to an example implementation.

FIG. 6 illustrates a portion 530 of the system 400 of FIG. 4, according to an example implementation. FIG. 6 is a view from below the deck (e.g., walking surface), which illustrates how the actuator 160 is coupled to the underside of the deck surface. Namely, the actuator 160 could be coupled to an underdeck mount 119 via a clevis pin or another type of rotatable coupling. Furthermore, FIG. 6 illustrates how at least a portion of the actuator 160 could pass through an opening 118 in the deck surface.

Figure 7:
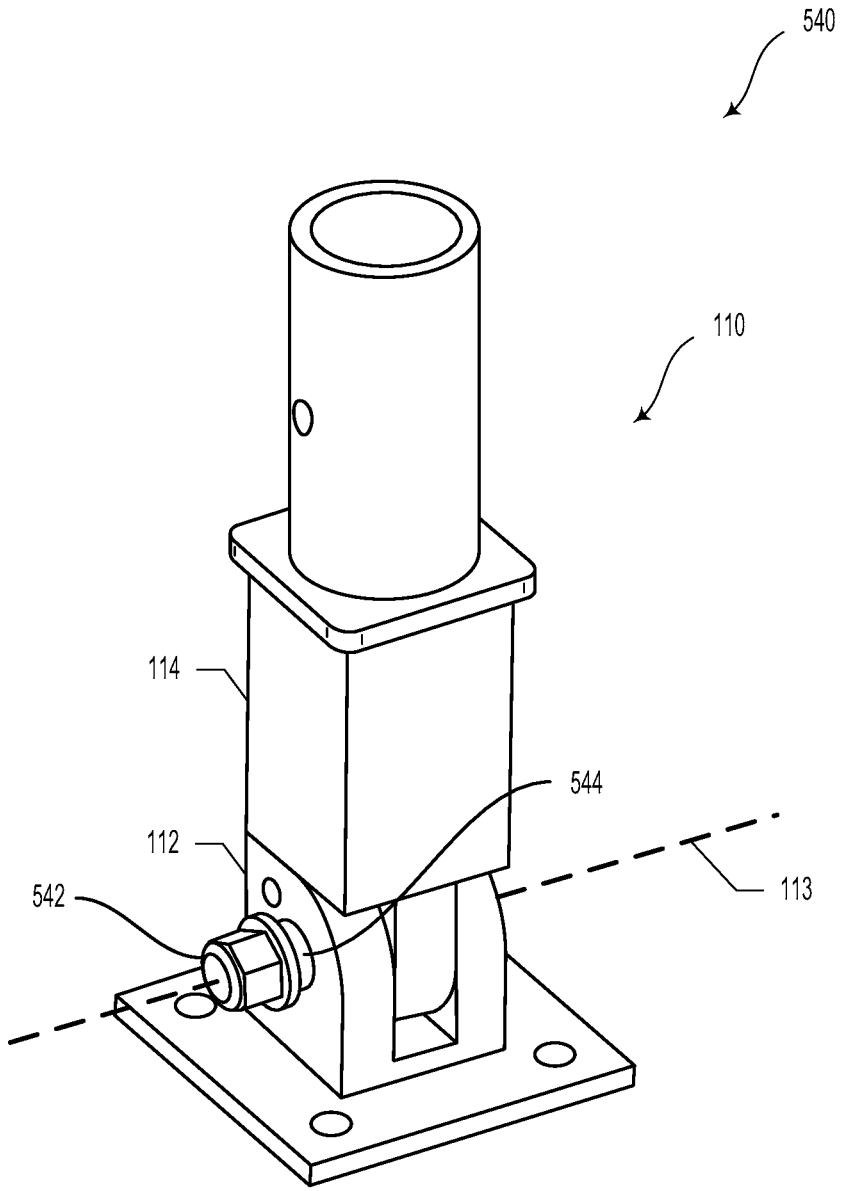
FIG. 7 illustrates a portion of the system of FIG. 4, according to an example implementation.

FIG. 7 illustrates a portion 540 of the system 400 of FIG. 4, according to an example implementation. Namely, FIG. 7 illustrates a rotating mount 110 having a lower weldment 112 and an upper weldment 114, which are rotatably coupled so as to rotate about a rotational axis 113. Furthermore, the rotating mount 110 could include a bearing 544 and a bolt 542. As an example, the bearing 544 could include a bushing or another type of device. Furthermore, by way of example, bearing 544 could be formed from bronze or another material having similar characteristics. Other types of rotating mounts are possible within the context of the present disclosure.

Figure 8:
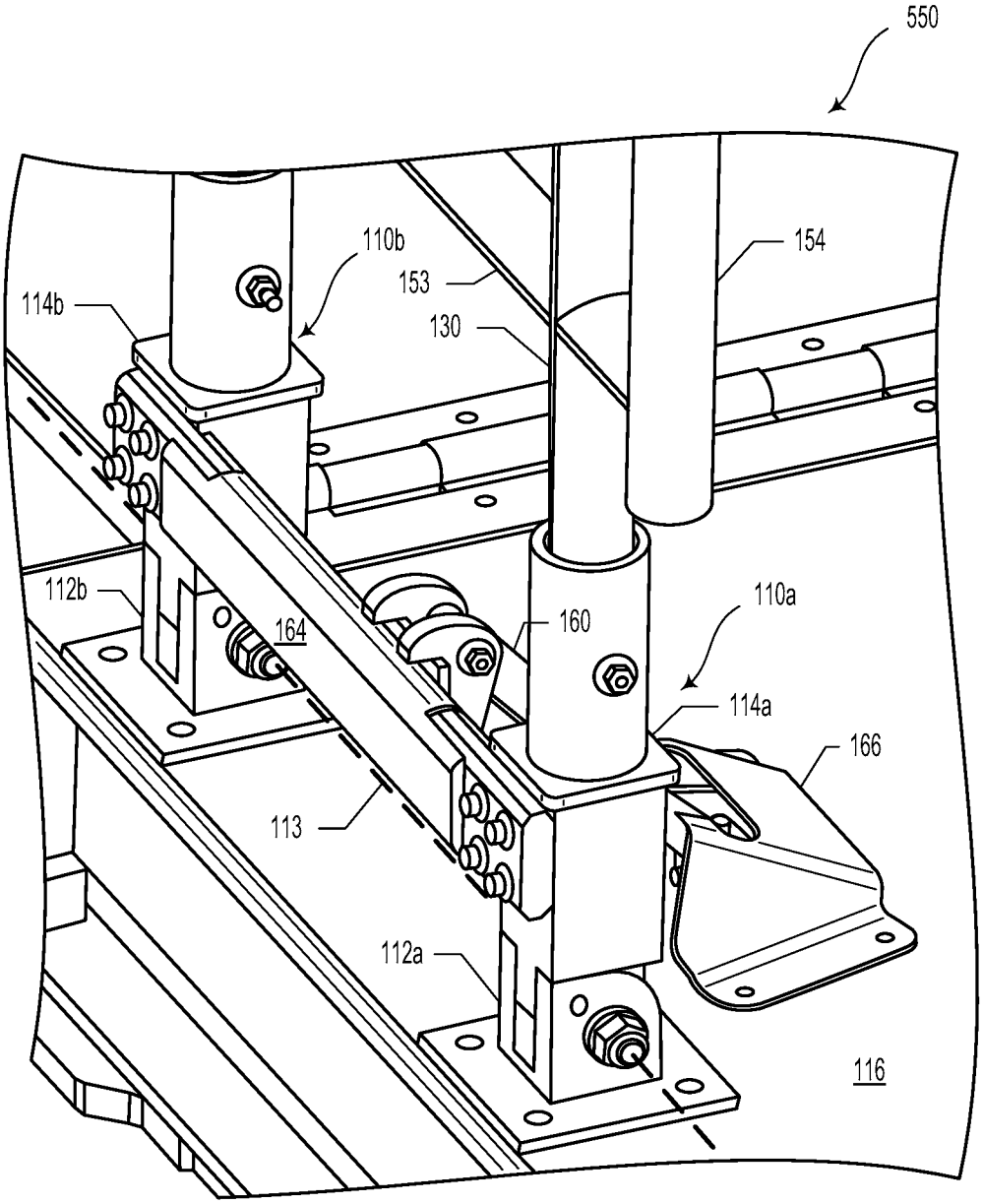
FIG. 8 illustrates a portion of the system of FIG. 4, according to an example implementation.

FIG. 8 illustrates a portion 550 of the system 400 of FIG. 4, according to an example implementation. Specifically, FIG. 8 illustrates a further view of the first rotating mount 110*a* and the second rotating mount 110*b*, which are configured to rotate about a common rotational axis 113.

Figure 9:
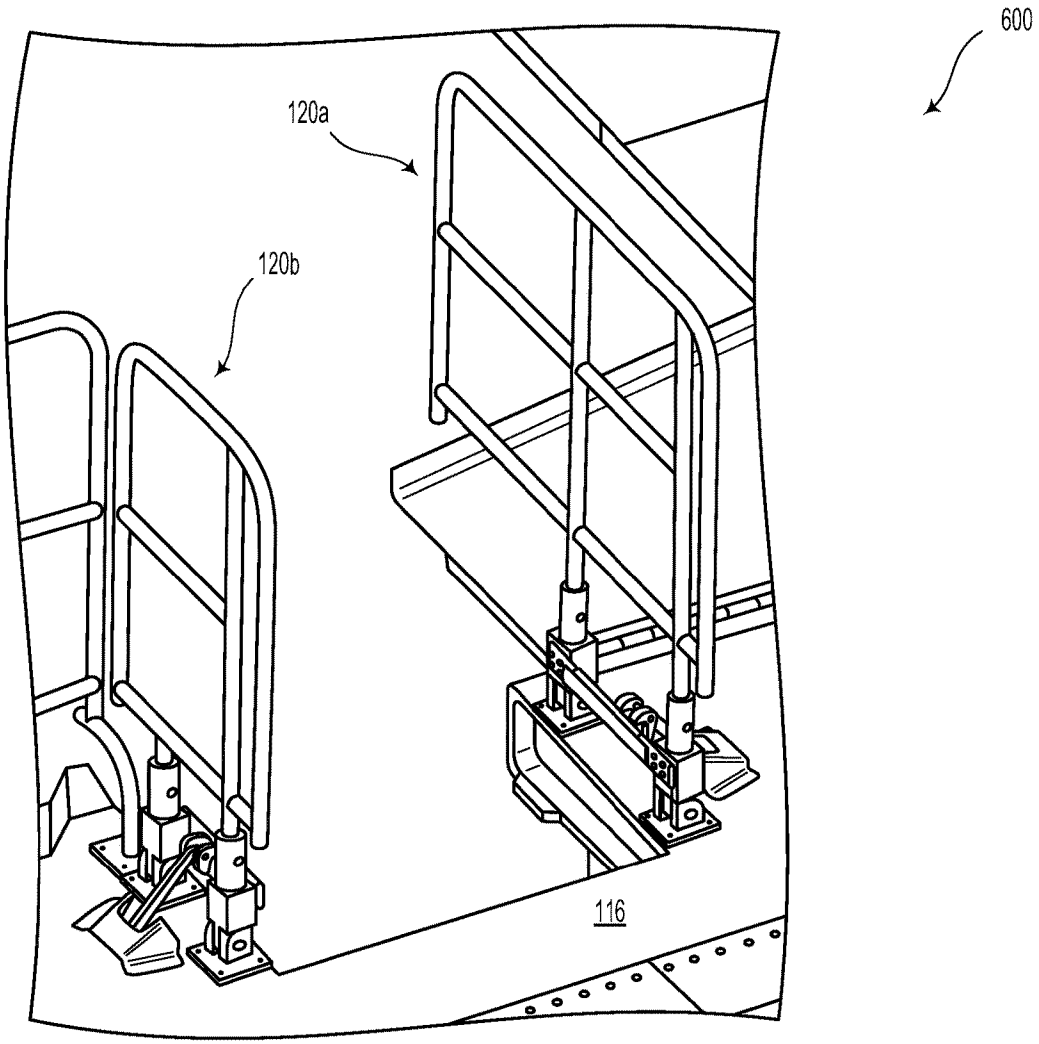
FIG. 9 illustrates an operating scenario, according to an example implementation.

FIG. 9 illustrates an operating scenario 600, according to an example implementation. FIG. 9 illustrates an EXTENDED POSITION in which a first guard rail weldment 120*a* and a second guard rail weldment 120*b* are upright and projecting substantially vertically from the walking surface 116.

Figure 10:
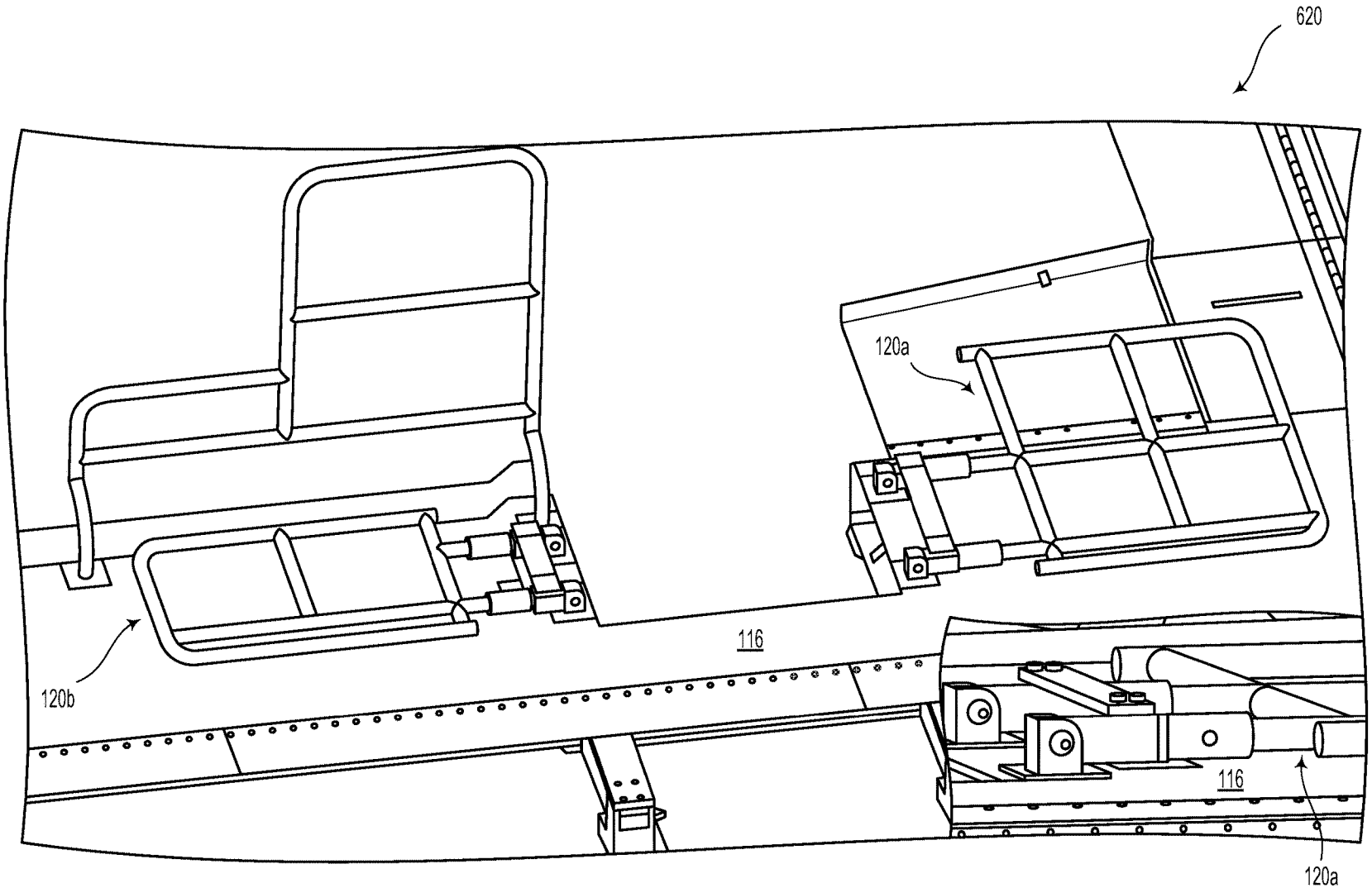
FIG. 10 illustrates an operating scenario, according to an example implementation.

FIG. 10 illustrates an operating scenario 620, according to an example implementation. FIG. 10 illustrates a RETRACTED POSITION in which a first guard rail weldment 120*a* and a second guard rail weldment 120*b* have been rotated downward so as to be substantially parallel to the walking surface 116.

III. Example Methods

Figure 11:
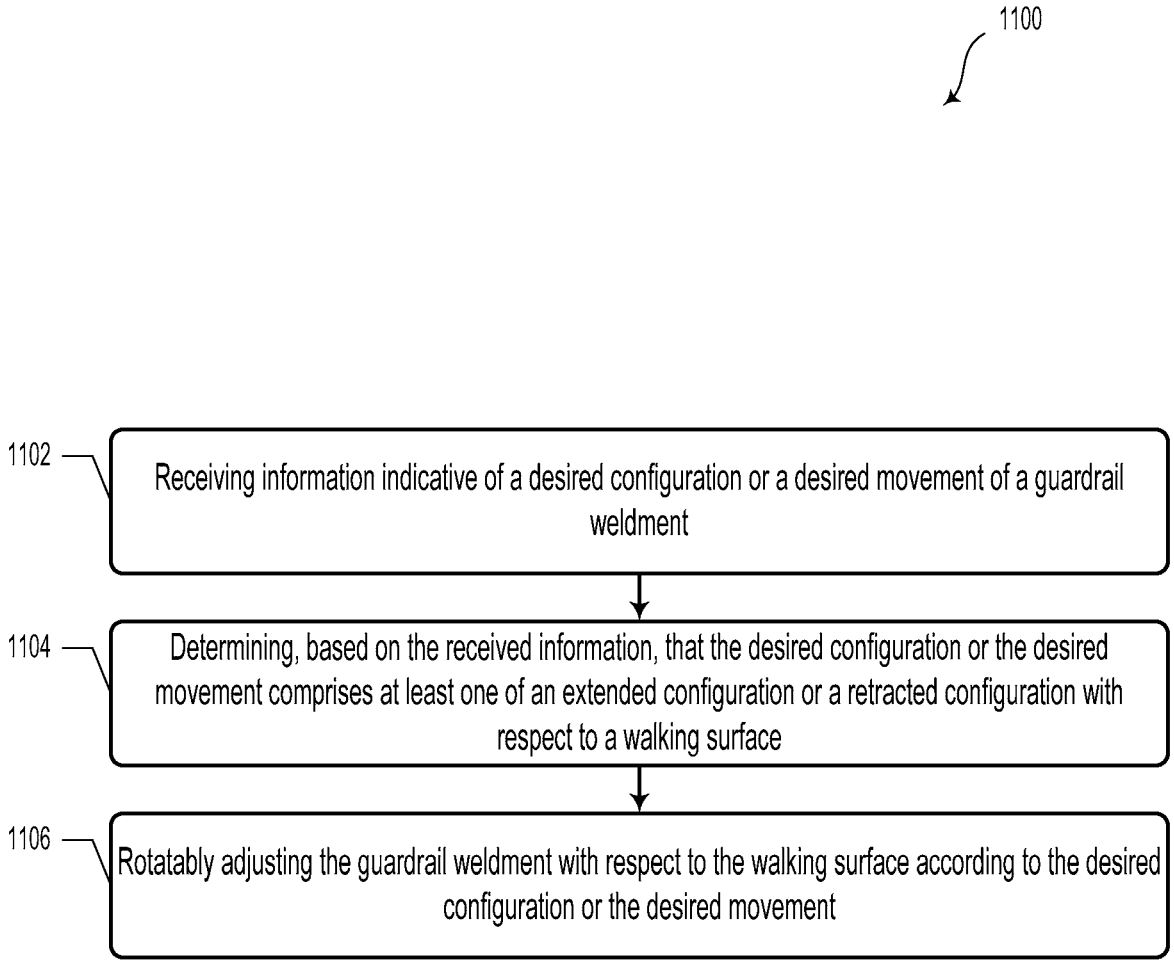
FIG. 11 illustrates a method, according to an example implementation.

FIG. 11 illustrates a method 1100, according to an example implementation. Method 1100 may involve elements of systems 100, 200, or 400 as illustrated and described in reference to FIGS. 1, 2, 4, 5, 6, 7, and 8. Additionally or alternatively, some or all elements of method 1100 may relate to elements of FIGS. 3, 9, and 10. While FIG. 11 illustrates certain blocks or steps as following a specific order, it will be understood that some blocks or steps could be omitted and/or other blocks or steps could be included. Furthermore, the blocks or steps could be carried out in a different order, in parallel (e.g., concurrently), and/or repeated. In some embodiments, at least some blocks of method 1100 could be carried out, at least in part, by controller 162, as illustrated and described in reference to FIG. 1.

Block 1102 includes receiving information indicative of a desired configuration or a desired movement of a guardrail weldment. For example, some embodiments could include receiving, from a remote unit (e.g., remote unit 170 as illustrated and described in reference to FIG. 1), information indicative of a desired configuration or a desired movement of a guardrail weldment of a movable deck platform. The movable deck platform includes a walking surface. A lower weldment of at least one rotating mount is coupled to the walking surface. The at least one rotating mount includes an upper weldment rotatably coupled to the lower weldment. The guardrail weldment is coupled to the upper weldment.

The information about the desired configuration or the desired movement could include a signal from a user interaction, which could include a user pushing a button, touching a touchscreen, moving a switch, a voice command, etc. For example, the remote unit could include two buttons—a first button to extend the guardrail weldment and a second button to retract the guardrail weldment. In response to a user pushing the button to extend the guardrail weldment, the remote unit may transmit the desired movement (extend the guardrail weldment) to an actuator controller or another type of control system. Similarly, in response to a user pushing the button to retract the guardrail weldment, the remote unit may transmit the desired movement (retract the guardrail weldment) to an actuator controller or another type of control system. In some examples, the signal to retract or extend the rail system may be transmitted while the user is pushing the corresponding button on the remote unit. For instance, a user may be able to control an amount of rail system extension by releasing a button once the rail system has reached a desired configuration (e.g., top rail height, etc.).

In other examples, the received information could include a desired configuration (e.g., fully retracted guardrail weldment or fully extended guardrail weldment). In such scenarios, a user need only push the corresponding button (or touchscreen icon) once to provide a signal relating to the desired configuration.

The information about the desired configuration or the desired movement could also include a signal from a computing system. For example, the signal could include an automated retraction command or an automated extension command. Additionally or alternatively, the information about the desired configuration or the desired movement could be provided according to a predetermined schedule and/or based on a planned movement of an aircraft, personnel shift change, among other possibilities.

Block 1104 includes determining, based on the received information, that the desired configuration or the desired movement includes at least one of an extended configuration or a retracted configuration with respect to the walking surface. In some embodiments, determining that the desired configuration or the desired movement includes at least one of the extended or retracted configurations could include comparing the received information to values stored in a look up table or another type of stored value or configuration.

Block 1106 includes rotatably adjusting the guardrail weldment (e.g., guardrail weldment 120 as illustrated and described in reference to FIG. 1) with respect to the walking surface according to the desired configuration or the desired movement, which is provided by the remote unit.

In such scenarios, method 1100 may also include, responsive to determining that the desired configuration includes the extended configuration, causing an actuator (e.g., actuator 160 as illustrated and described with reference to FIG. 1) to move the guardrail weldment into the extended configuration. Furthermore, method 1100 could include, responsive to determining that the desired configuration includes the retracted configuration, causing the actuator to move the guardrail weldment into the retracted configuration.

In some embodiments, method 1100 could include receiving, from at least one limit switch, information indicative of the guardrail weldment and/or the actuator reaching a position limit. In such scenarios, method 1100 could include, responsive to receiving the information indicative of the guardrail weldment and/or the actuator reaching a position limit, causing the actuator to stop moving the guardrail weldment. In some embodiments, the limit switch could include a pressure sensor or contact switch attached to at least one of the guardrail weldment or the actuator.

The particular arrangements shown in the Figures should not be viewed as limiting. It should be understood that other embodiments may include more or less of each element shown in a given Figure. Further, some of the illustrated elements may be combined or omitted. Yet further, an illustrative embodiment may include elements that are not illustrated in the Figures.

A step or block that represents a processing of information can correspond to circuitry that can be configured to perform the specific logical functions of a herein-described method or technique. Alternatively or additionally, a step or block that represents a processing of information can correspond to a module, a segment, or a portion of program code (including related data). The program code can include one or more instructions executable by a processor for implementing specific logical functions or actions in the method or technique. The program code and/or related data can be stored on any type of computer readable medium such as a storage device including a disk, hard drive, or other storage medium.

The computer readable medium can also include non-transitory computer readable media such as computer-readable media that store data for short periods of time like register memory, processor cache, and random access memory (RAM). The computer readable media can also include non-transitory computer readable media that store program code and/or data for longer periods of time. Thus, the computer readable media may include secondary or persistent long term storage, like read only memory (ROM), optical or magnetic disks, compact-disc read only memory (CD-ROM), for example. The computer readable media can also be any other volatile or non-volatile storage systems. A computer readable medium can be considered a computer readable storage medium, for example, or a tangible storage device.

The description of the different advantageous arrangements has been presented for purposes of illustration and description, and is not intended to be exhaustive or limited to the examples in the form disclosed. Many modifications and variations will be apparent to those of ordinary skill in the art. Further, different advantageous examples may describe different advantages as compared to other advantageous examples. The example or examples selected are chosen and described in order to best explain the principles of the examples, the practical application, and to enable others of ordinary skill in the art to understand the disclosure for various examples with various modifications as are suited to the particular use contemplated.

What is claimed is:

1. A system comprising:

at least one rotating mount comprising a lower weldment rotatably coupled to an upper weldment and further comprising at least one receiver, wherein the upper weldment is directly coupled to the at least one receiver, and wherein the lower weldment is coupled to a walking surface;

a guardrail weldment coupled by way of the at least one receiver to the upper weldment of the at least one rotating mount; and an actuator configured to controllably adjust a configuration of the guardrail weldment between an extended configuration and a retracted configuration with respect to the walking surface, wherein the extended configuration comprises the guardrail weldment extending substantially perpendicular from the walking surface, and wherein the retracted configuration comprises the guardrail weldment disposed substantially parallel to the walking surface, wherein the at least one receiver is directly coupled to the guardrail weldment by way of receiving at least one post of the guardrail weldment into the at least one receiver such that each post of the at least one post is substantially aligned with a corresponding receiver of the at least one receiver and an upper weldment of a corresponding rotating mount of the at least one rotating mount in both the extended configuration and the retracted configuration, wherein the walking surface is defined by an upper surface of a deck platform, wherein a first end of the actuator is coupled to the guardrail weldment by way of an actuator weldment, wherein a second end of the actuator is pivotably coupled to an underdeck mount that is coupled to a lower surface of the deck platform, wherein at least a portion of the actuator passes through an opening in the upper surface of the deck platform, wherein the opening is at least partially covered by an actuator cover that extends upwardly from the upper surface, and wherein the actuator cover comprises a respective opening that partially surrounds the actuator and that allows the actuator to pivot between the extended configuration and the retracted configuration.

2. The system of claim 1, wherein the guardrail weldment comprises a first post and a second post, wherein the first post is coupled to an upper weldment of a first rotating mount, and wherein the second post is coupled to an upper weldment of a second rotating mount.

3. The system of claim 2, wherein the first rotating mount and the second rotating mount are configured to rotate about a shared rotational axis.

4. The system of claim 1, wherein the second end of the actuator is coupled to the walking surface.

5. The system of claim 4, wherein the guardrail weldment comprises a first post and a second post, wherein the actuator weldment is coupled to an upper weldment of a first rotating mount and an upper weldment of a second rotating mount, wherein the first end of the actuator is coupled to a middle portion of the actuator weldment.

6. The system of claim 5, wherein the at least one receiver is configured to insertably receive a portion of the first post or a portion of the second post of the guardrail weldment.

7. The system of claim 1, wherein the guardrail weldment comprises:

a top rail;

a mid rail;

a lower rail; and a plurality of posts, wherein each of the respective rails are coupled to at least two of the plurality of posts.

8. The system of claim 7, wherein at least one of the top rail, the mid rail, or the lower rail extends beyond a span defined by the plurality of posts to provide a wing rail.

9. The system of claim 7, wherein adjusting the configuration of the guardrail weldment between the extended configuration and the retracted configuration comprises rotatably adjusting a position of the guardrail weldment with respect to the walking surface.

10. The system of claim 1, wherein the lower weldment is rotatably coupled to the upper weldment by way of at least one of: (i) a rotary bearing; or (ii) at least one rotary bushing and a stripper bolt.

11. The system of claim 1, wherein the actuator comprises an electric ball-screw linear actuator comprising an actuator arm with a throw range between 100 mm to 300 mm.

12. The system of claim 1, wherein the lower surface comprises an underside surface of the deck platform, wherein the lower surface of the deck platform is disposed opposite the upper surface of the deck platform.

13. The system of claim 1, further comprising a remote unit configured to control a position of the actuator, wherein the remote unit comprises a wired remote controller having a user interface, wherein the user interface comprises at least one button.

14. The system of claim 1, further comprising a controller, wherein the controller executes instructions so as to carry out operations, the operations comprising:

responsive to receiving information indicative of an extension command, causing the actuator to move the guardrail weldment into the extended configuration; and responsive to receiving information indicative of a retraction command, causing the actuator to move the guardrail weldment into the retracted configuration.

15. The system of claim 14, further comprising at least one limit switch, wherein the at least one limit switch is configured to providing information indicative of the guardrail weldment reaching a position limit, wherein causing the actuator to move the guardrail weldment comprises moving the guardrail weldment until receiving the information indicative of the guardrail weldment reaching the position limit.

16. The system of claim 1, wherein the at least one receiver is directly coupled to the guardrail weldment by way of receiving at least one post of the guardrail weldment into the at least one receiver such that each post of the at least one post is substantially aligned in a longitudinal direction with a corresponding receiver of the at least one receiver and an upper weldment of a corresponding rotating mount of the at least one rotating mount in both the extended configuration and the retracted configuration.

17. The system of claim 1, wherein the lower weldment is directly coupled to the walking surface.

18. A movable deck platform comprising:

a continuously planar walking surface;

at least one rotating mount comprising a lower weldment rotatably coupled to an upper weldment and further comprising at least one receiver, wherein the upper weldment is directly coupled to the at least one receiver, and wherein the lower weldment is coupled to the walking surface;

a guardrail weldment coupled by way of the at least one receiver to the upper weldment of the at least one rotating mount; and an actuator configured to controllably adjust a configuration of the guardrail weldment between an extended configuration and a retracted configuration with respect to the walking surface, wherein the at least one receiver is directly coupled to the guardrail weldment by way of receiving at least one post of the guardrail weldment into the at least one receiver such that each post of the at least one post is substantially aligned with a corresponding receiver of the at least one receiver and an upper weldment of a corresponding rotating mount of the at least one rotating mount in both the extended configuration and the retracted configuration, wherein the walking surface is defined by an upper surface of a deck platform, wherein a first end of the actuator is coupled to the guardrail weldment by way of an actuator weldment, wherein a second end of the actuator is pivotably coupled to an underdeck mount that is coupled to a lower surface of the deck platform, wherein at least a portion of the actuator passes through an opening in the upper surface of the deck platform, wherein the opening is at least partially covered by an actuator cover that extends upwardly from the upper surface, and wherein the actuator cover comprises a respective opening that partially surrounds the actuator and that allows the actuator to pivot between the extended configuration and the retracted configuration.

19. The movable deck platform of claim 18, wherein the walking surface defines a reference plane, wherein the extended configuration comprises the guardrail weldment extending substantially perpendicular from the reference plane, and wherein the retracted configuration comprises the guardrail weldment disposed substantially parallel to the reference plane.

20. The movable deck platform of claim 18, wherein the guardrail weldment comprises:

a top rail;

a mid rail;

a lower rail; and a plurality of posts, wherein each of the respective rails are coupled to at least two of the plurality of posts.

* * * * *